US009339135B2

(12) United States Patent
Terkanian

(10) Patent No.: US 9,339,135 B2
(45) Date of Patent: May 17, 2016

(54) PERSONAL CLOTHING MANAGEMENT SYSTEM AND ASSOCIATED METHOD OF USE

(71) Applicant: Susan Terkanian, Spencer, MA (US)

(72) Inventor: Susan Terkanian, Spencer, MA (US)

( * ) Notice: Subject to any disclaimer, the term of this patent is extended or adjusted under 35 U.S.C. 154(b) by 0 days.

(21) Appl. No.: 14/591,989

(22) Filed: Jan. 8, 2015

(65) Prior Publication Data

US 2015/0191300 A1 Jul. 9, 2015

Related U.S. Application Data

(60) Provisional application No. 61/924,853, filed on Jan. 8, 2014.

(51) Int. Cl.
*A47G 25/14* (2006.01)
*A47G 25/00* (2006.01)

(52) U.S. Cl.
CPC ..... *A47G 25/1471* (2013.01); *A47G 25/00* (2013.01)

(58) Field of Classification Search
CPC ..... A47G 25/1471; A47G 25/1442; A47G 25/1407
See application file for complete search history.

(56) References Cited

U.S. PATENT DOCUMENTS

| | | | | | |
|---|---|---|---|---|---|
| 1,422,973 | A * | 7/1922 | Hertzberg | G09F 3/14 | 40/659 |
| 2,176,713 | A * | 10/1939 | Hendrix | G09F 3/20 | 40/652 |
| 2,288,071 | A * | 6/1942 | Cohen | A47F 7/24 | 211/184 |
| 5,002,183 | A * | 3/1991 | Okano | A47G 25/58 | 206/287 |
| 2007/0084145 | A1* | 4/2007 | Scheerer | A61L 2/081 | 53/425 |

* cited by examiner

*Primary Examiner* — Gary Hoge
(74) *Attorney, Agent, or Firm* — Bay State IP, LLC

(57) ABSTRACT

The present invention is a personal clothing-management-system kit and method that facilitates on-going, self-determined organization of one's close and clothing items. The kit provides a plurality of two-sided hanging designation dividers, a plurality of adjustable designation divider hangers, a Donation bag and a Discard bag. This invention empowers consumer-users to continuously and gently determine, at one's own time and own comfort level, what pieces of clothing items to keep, discard, and/or donate, while separating any kept clothing items that require mending or alterations or ironing. The overarching goal of this invention is to enable consumer-users to look good, feel confident about their clothing choices and overall appearance, and avoid stress by controlling the chaos of their closet space.

18 Claims, 7 Drawing Sheets

PERSONAL CLOTHING MANAGEMENT SYSTEM AND ASSOCIATED METHOD OF USE

CROSS-REFERENCE TO RELATED APPLICATION

This application takes priority from and claims the benefit of U.S. Provisional Application No. 61/924,853 filed on Jan. 8, 2014.

BACKGROUND OF THE INVENTION

1. Field of the Invention

The present system relates generally to a personal clothing-management-system kit and method for the ongoing, self-driven organization of personal clothing items. Particularly, the system and associated method of use relate to the ongoing process of gently determining at one's own time and own comfort level, what pieces of one's clothing items to keep, discard, and/or donate, and separate any kept pieces that require mending or ironing.

2. Description of the Related Art

In a culture where more options are haled as better than fewer, and status is heavily influenced by a person's appearance and clothing, home closets are brimming with more options than ever, yet are at an all-time-high state of disarray. The adage "a closet full of clothes with nothing to wear" has never rung truer. With numerous pieces and options, the ordinary person is often overwhelmed with choices and has to try on multiple pieces before finding an outfit that is ironed, mended, and fits just right.

Current clothing management systems are available to tackle the closet chaos ubiquitous in such "closets full of clothes," but they often prove overwhelming and stressful to their consumer-users. These conventional systems require significant time and energy in a single setting to manage, organize, and decide what pieces to keep, discard, and/or donate. Such systems, even if successfully used to organize one's wardrobe once, do not empower consumers to continuously control their clothing based on its fit, cleanliness, desirability, and overall appearance. These systems do not tap into the emotional or psychological ties to clothing and the need to continuously stay organized while feeling good about one's appearance.

Most current clothing management systems relate to the hanging or storage aspect of clothing, more particularly to different physical systems including hanging devices to utilize all available vertical closet space, and methods of organizing existing closet space to strategically fit more items, such as through vacuum compression or strategic shelving. Existing organizing systems can require significant work to install, and do not aid in the ongoing organization of one's wardrobe. These traditional organizer and management systems do not facilitate easy storage or retrieval of clothing items, and perpetuate the "more options are better" theme. Additionally, systems that do motivate consumer-users to sort and streamline their wardrobes by discarding or donating items that the consumer-user no longer desires or wears are overwhelming and stressful experiences because they require a single-session purge of every item in one's closet, make a daunting, messy pile to sort through, and do not enable the consumer-user to continuously review their wardrobe selections.

Other existing clothing management systems track number of wears and/or the date an item was last worn or cleaned through a numerical monitor affixed to the garment's hanger or otherwise on or near the garment. Some of these types of devices may be programmed to alert the consumer-user to launder the corresponding garment once the monitor indicates a certain number of wears. These systems, while helpful for tracking laundering schedules and helping promote more even wear of garments, fail to address whether certain items should be kept, discarded, or donated.

Other systems purport to help consumer-users sort clothing by type or attribute, enabling them to quickly identify the type of clothes—shirts, skirts, pants, for example—by a hanging identifier in a representative shape of the attribute of the clothes such identifier is separating. Still other wardrobe organization inventions exist in the form of plastic clothes hangers with a unique tag apparatus connected to the central hook and/or each horizontally extending arm of the hanger, for the purpose of a user customizing the identification tag to help sort items. For similar reasons previously mentioned, this invention also falls short of providing an ongoing system enabling consumers to continuously monitor, organize, and optimize their wardrobes.

My Wardrobe Genius, personal clothing management assistant kit, fulfills a market need to enable consumers to manage and organize their clothes continuously, enabling them to look good, feel confident about their clothing choices and overall appearance, and avoid stress by controlling the chaos of their closet space. The system, by gently guiding consumers to discern, decide, donate, and discard at their own pace, clothing article by clothing article, removes the stress and pressure from making many difficult, potentially emotional, decisions at once. It also removes the clutter and mess from tackling closet organization in one sitting, leaving no mess to clean up.

Additionally, it enables consumers to save money by learning to make the wisest clothing selections on future purchases by learning what pieces in their wardrobe consistently work for their lifestyle and bodies.

SUMMARY OF THE INVENTION

The present device, as illustrated herein, is clearly not anticipated, rendered obvious, or even present in any of the prior art mechanisms, either alone or in any combination thereof.

The physical product and method encompassing the present invention centers on the innovative concept of providing gentle prodding to streamline and organize one's wardrobe, at one's own time and pace. The overarching benefit of the present invention is peace of mind for the consumer-user. It provides a systematic approach to evaluating one's wardrobe without outside assistance. The invention helps consumer-users transform their wardrobes into ones that make them look and feel their best, while eliminating the often overwhelming stress and time of trying to manage all clothes in one session. The present invention eliminates the angst of having a closet full of clothes but feeling as if you don't have anything to wear, enabling the consumer-user to determine at his/her own pace what he/she likes, what he/she will wear most often, and what makes him/her feel most confident.

Four principles govern the use of the present invention: Discern, Decide, Donate, and Discard. Discern is the driving principle and involves the consumer-user evaluating a clothing item to determine which one of the next three options is appropriate: Decide means the consumer-user decided to keep the item; Donate means the consumer-user is giving away the item, acknowledging that the item was enjoyed, while also feeling a sense of satisfaction in donating the item to someone else; and Discard refers to the consumer-user appreciating the value the item brought to his/her life but acknowledging that the time has come for the item to be retired, and discarded. These guiding principles, coupled with the physical pieces of the present invention, provide a structure for organizing one's wardrobe, but also give enough freedom to the consumer-user to tailor the organization to what personally works for that consumer-user (i.e. grouping shirts by a color, skirts, or pants together, etc.).

The present invention helps consumer-users define a personal, unique style and become a smarter shopper who makes better purchasing choices. As a result, the size of one's wardrobe may decrease, but will consist of better pieces, and may enable the consumer-user to purchase higher quality clothing that fits better and will last longer. The present invention may also eliminate the stress of looking at one's "fat clothes," glaring reminders of one's unsuccessful weight-loss attempts; it will empower a consumer-user to be able to keep his/her "skinny clothes" close, so when he/she is able to start wearing them again, he/she can reintroduce them back into his/her wardrobe one piece at a time.

Alternatively, if the user does not want to remove their "fat clothes" and/or their "skinny clothes", they may keep them, however they would simply need to box them up and/or move them to another closet. The main objective of the present invention is to get these clothes out of the mainstream (i.e. out of sight decreases shame and stress). Therefore, ultimately a user of the invention should only have clothes in their closet that a) fits right now; b) he/she likes; c) that makes him/her feel great; and d) that fits the life he/she is living now.

The present invention is packaged as a kit with a plurality of dividers a consumer-user can choose to use. The kit more specifically contains: at least five, two-sided, hanging designation dividers, one each of Discerning/Decided, Ironing to be done, Mending/Alterations, Spare Hangers, and one My Choice customizable Divider that the user can personalize (i.e. "Winter Clothes"); five adjustable designation divider hangers to thread through the top holes of designation dividers to enable hanging on a closet rod; one Donation bag; and one Discard bag with labels specified as Donate and Discard to distinguish one from the other.

To use the present invention, a consumer-user first moves all clothing to one end of the closet clothing rod, then hangs each plastic laminate divider from the clothing rod in the following order, either from left to right, or from right to left, but in the opposite direction from the side where the clothing was pushed: My Choice customizable divider, Discerning/Decided, Ironing to be done, Mending/Alterations, and Spare Hangers. At this point, the consumer-user takes all empty hangers and places them behind the Spare Hangers divider, keeping only a couple of each kind of hanger at any time. Any clothes needing mending or alterations should then be hung between the Mending/Alterations divider and the Spare Hanger divider. Any clean clothes needing ironing should then be hung between the Ironing to be done divider and the Mending/Alterations divider. Next, the consumer-user will begin sorting through all remaining clothes, with an eye towards pulling out of the wardrobe clothes that are too large or too small but still wearable, discarding unwearable clothes, or packing away and relocating any clothes that the consumer-user may wear again.

Now, the consumer-user begins sorting through their clothing that remains hanging. The clothes remaining for discerning may be moved between the Discerning divider and the Decided divider. For clothing that needs to further be discerned, the consumer-user may consider questions such as the last time the item was worn, whether it fits, whether the consumer-user likes it, whether it is stained, torn, or missing buttons, whether the item is still in good condition, whether the item makes the consumer-user feel great, whether the item fits the life the consumer-user is living currently. Then, after discerning and asking the necessary questions, the consumer determines which items they have decided to keep, mend, donate, or discard. For decided clothing, a user may move the article of clothing between the Decided/divider and the Ironing to be done divider. Decided items may be clothing the consumer-user is keeping because it fits, the consumer-user likes it, the item makes the consumer-user feel great, the item fits the life the consumer-user is living currently.

Wearing an item may require laundering it afterwards, and subsequently, ironing; in this case, the consumer-user may hang it between the Ironing to be done divider and the Mending/Alterations divider after laundering. If a worn item does not need ironing, or even laundering, it may be hung between the Decided/divider and Ironing to be done divider. Similarly, if an item needs mending or alteration, it may be hung between the Mending/Alterations and Spare Hangers dividers. The consumer may repeat the process with each piece of clothing he/she selects from between Discerning and Decided of the system until the end of the season or whatever time frame he/she decides on.

Any new items of clothing will always start on the Discerning side of the divider until actually worn. Additionally, if, after wearing any item, the consumer-user decides not to wear an item again, he/she may put it in the Donate bag if it is wearable, or the Discard bag if unwearable. Both bags may be kept inside the closet, on the floor, or wherever is convenient for the consumer-user.

Ultimately, the consumer-user can continuously address the clothing that is between the Discerning side of the divider of the system at their own time and pace, with confidence and a peace of mind that they can let go of anything that will not be worn, and with satisfaction that he/she is helping someone else to enjoy an item, or that he/she has reaped the best value and most possible use out of an item. Once the consumer-user has no more items left on the Discerning side of the divider and everything is between the Decided an Ironing to be done dividers, the consumer-user can move the items back to the Discerning side of the divider to repeat the process and keep any clothing clutter at bay.

There has thus been outlined, rather broadly, the more important features of a personal clothing management system and associated use that the detailed description thereof that follows may be better understood, and in order that the present contribution to the art may be better appreciated. There are additional features of the device that will be described hereinafter and which will form the subject matter of the claims appended hereto.

In this respect, before explaining at least one embodiment of the device in detail, it is to be understood that the device is not limited in its application to the details of construction and to the arrangements of the components set forth in the following description or illustrated in the drawings. The device is capable of other embodiments and of being practiced and carried out in various ways, including applications involving the art discussed herein. Also, it is to be understood that the phraseology and terminology employed herein are for the purpose of description and should not be regarded as limiting.

These together with other objects of the device, along with the various features of novelty, which characterize the device, are pointed out with particularity in the claims annexed to and forming a part of this disclosure. For a better understanding of the device, its operating advantages and the specific objects attained by its uses, reference should be made to the accompanying drawings and descriptive matter in which there are illustrated preferred embodiments of the system.

BRIEF DESCRIPTION OF THE DRAWINGS

Advantages of the present device will be apparent from the following detailed description of exemplary embodiments thereof, which description should be considered in conjunction with the accompanying drawings, in which.

DETAILED DESCRIPTION OF THE SEVERAL EMBODIMENTS

The following detailed description is of the best currently contemplated mode of carrying out the invention. The description is not to be taken in a limiting sense, but is made merely for the purpose of illustrating the general principles of the invention.

The detailed description set forth below is intended as a description of presently preferred embodiments of the invention and does not represent the only forms in which the present device may be construed and/or utilized. The description sets forth the functions and the sequence of the steps for producing the device. However, it is to be understood that the same or equivalent functions and sequences may be accomplished by different embodiments also intended to be encompassed within the scope of the invention.

Figure 1:
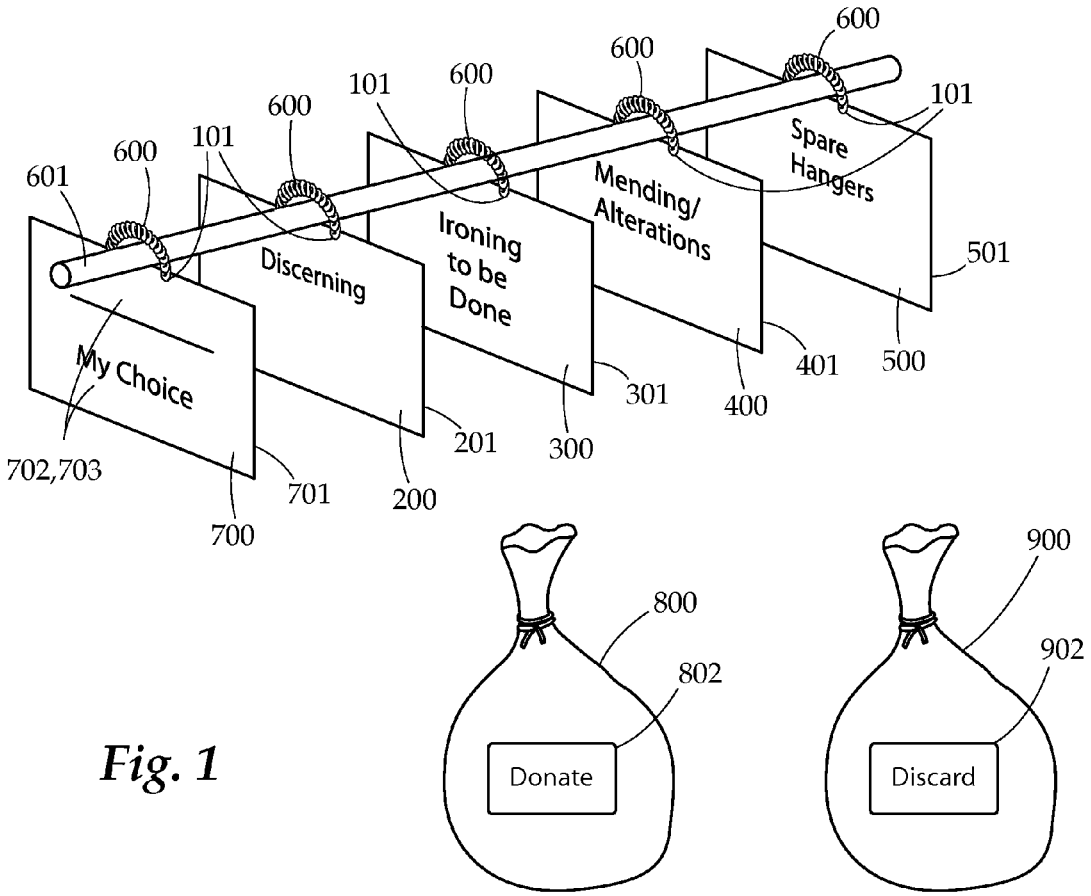
FIG. 1 is one perspective view of the present invention assembled in its entirety, with all plastic laminate dividers in FIGS. 2-7 hanging inside a closet on a closet rod and with the Discard and Donate bags in FIGS. 9-10 stored on the floor underneath the closet rod.

The present invention is generally embodied in a personal clothing management system kit 90, depicted as a whole in FIG. 1, consisting of: five, two-sided, hanging designation dividers, one of each for Discerning 200/Decided 201, Ironing to be done 300, 301, Mending/Alterations 400, 401, Spare Hangers 500, 501, and one My Choice customizable Divider 700, 701 that the consumer-user can personalize (i.e. "Winter Clothes"); five adjustable designation divider hangers 600 to thread through the top holes of designation dividers 101 to enable hanging on a closet rod 601; one Donation bag 800; one Discard bag 900; one Donate and one Discard label.

Figure 2A:
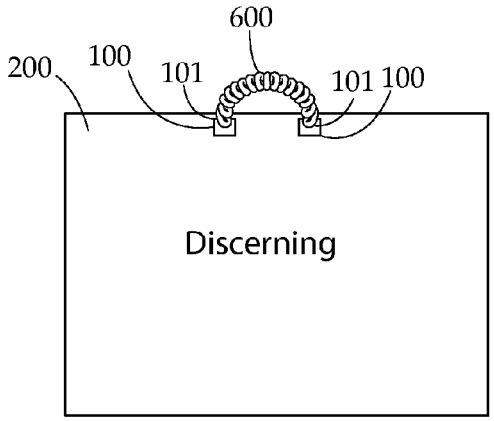
FIG. 2A and FIG. 2B are prospective front and reverse side of the Discerning/Decided plastic laminate divider that hangs over a closet clothing rod to organizationally divide a consumer's hanging clothing within said closet, based on what the consumer has decided to keep, or on what the consumer is still discerning whether to keep, discard, or donate the item.
Figure 2B:
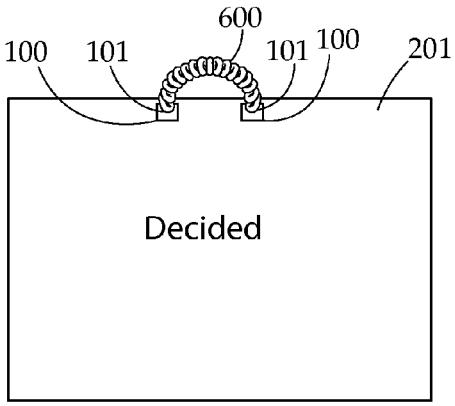

FIGS. 2A and 2B depict a prospective view of the front 200 and reverse 201 sides of the Discerning/Decided plastic laminate divider that hangs over a closet clothing rod 601 to organizationally divide a consumer's hanging clothing within said closet, based on what the consumer has decided to keep, or on what the consumer is still discerning whether to keep, discard, or donate the item. The adjustable divider hanging mechanism 600 is threaded through one hole 101, over the closet clothing rode 601, and back through the second hole 101, which is placed at a distance far enough away from the first hole 100 to accommodate the girth of a closet clothing rod 601.

Figure 2C:
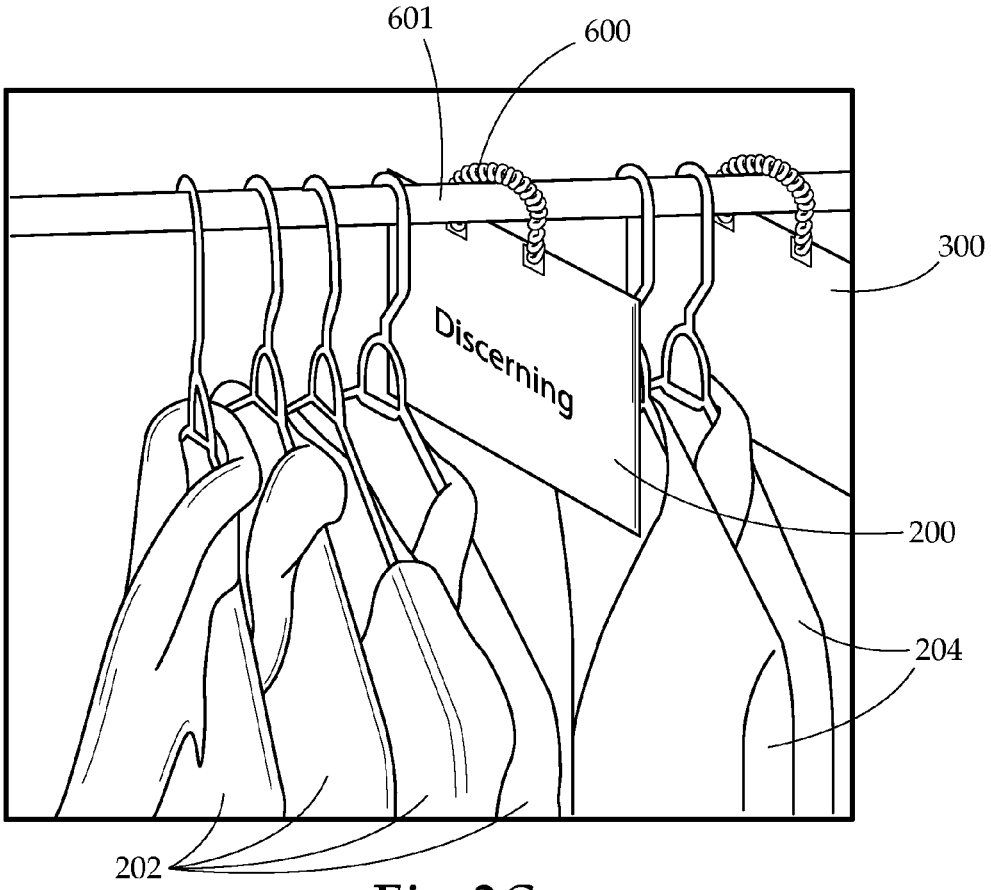
FIG. 2C is a perspective view of the Discerning plastic laminate divider in FIGS. 2A and 2B, with clothing for Discerning/Decided that hangs over the closet clothing rod and organizationally divides a consumer-user's clothing within said closet.

FIG. 2C shows a perspective view of one of the sides of the Discerning divider 200 and the clothing for the consumer-user to discern whether to keep, donate, or discard 202 hanging over the closet clothing rod 601 by the adjustable divider hanging mechanism 600. The Figure additionally shows clothing that has been Decided to keep 204, separated from the clothing still needing discerning 202.

Figure 3A:
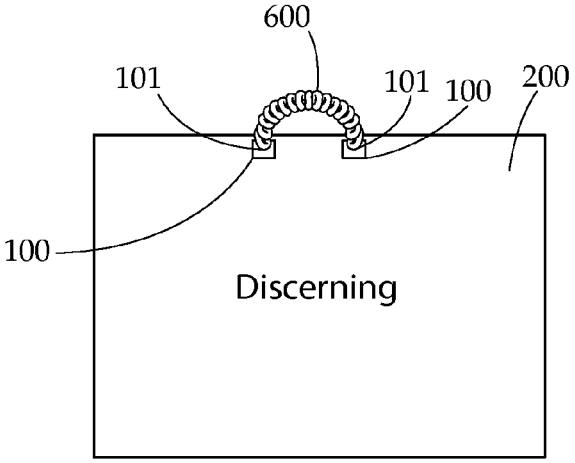
FIGS. 3A and 3B are prospective views of the front and reverse sides of the Discerning/Decided plastic laminate dividers that hangs over a closet clothing rod and organizationally divides a consumer-user's hanging clothing within said closet, based on what the consumer has decided to keep.
Figure 3B:
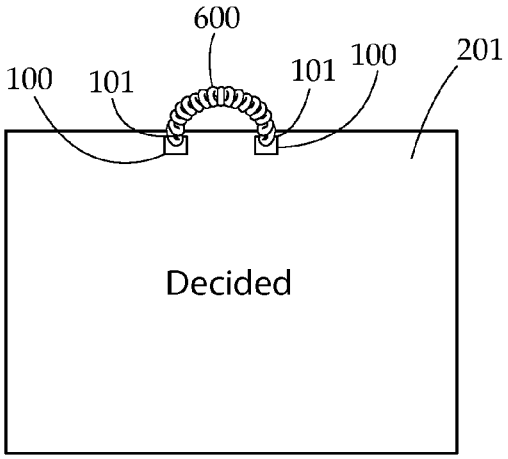

FIGS. 3A and 3B depict a prospective view of the identical front 203, and reverse 205 sides of the Decided plastic laminate divider that hangs over a closet clothing rod 601 to organizationally divide a consumer's hanging clothing within said closet, based on what the consumer has decided to keep, or on what the consumer is still discerning whether to keep, discard, or donate the item. The adjustable divider hanging mechanism 600 is threaded through one hole 101, over the closet clothing rode 601, and back through the second hole 101, which is placed at a distance far enough away from the first hole 100 to accommodate the girth of a closet clothing rod 601.

Figure 3C:
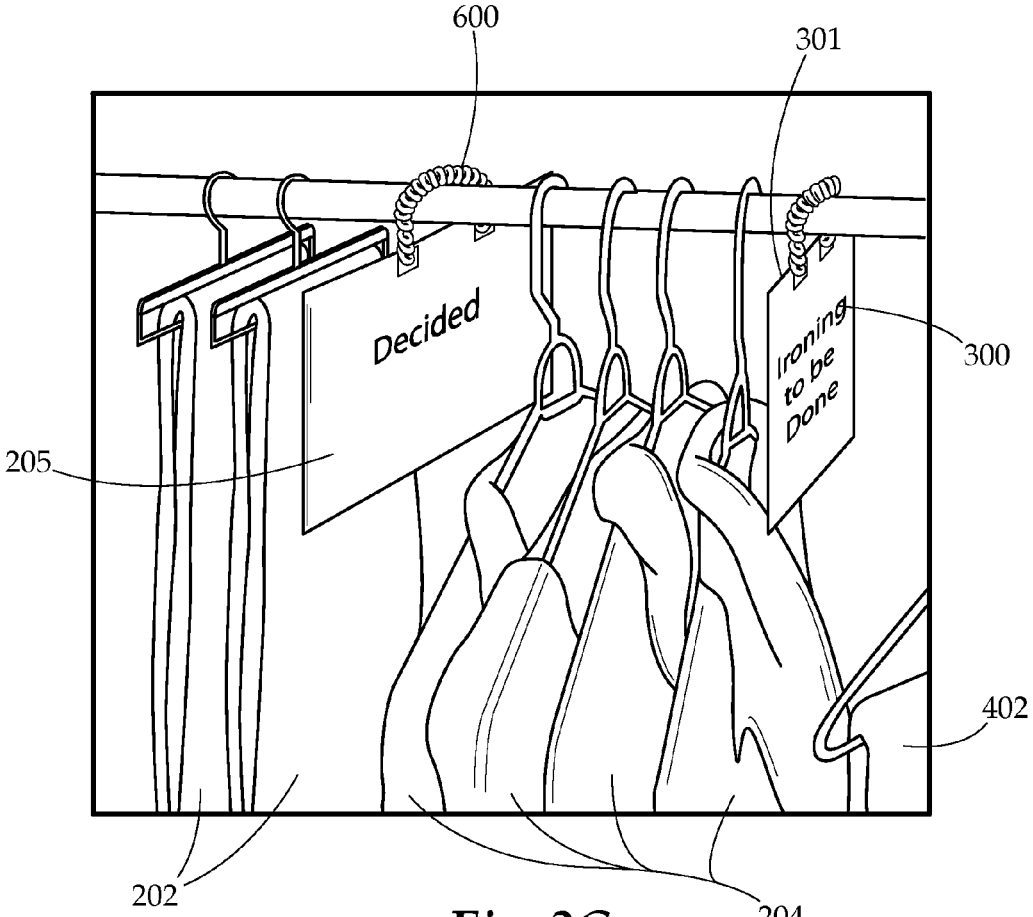
FIG. 3C is a perspective view of the Decided side of the plastic laminate divider, depicting clothing that a consumer-user has decided to keep, indicated by placing said items between the Decided divider and the Ironing to be done divider indicated in FIGS. 3A and 3B.

FIG. 3C shows a perspective view of clothing 202 that is still being discerned by the consumer-user, and clothing 204 items that have been placed in between the Decided side 201 of the divider and the Ironing to be done divider 300, 301 hanging over the closet clothing rod 601 by the adjustable divider hanging mechanism 600. The Figure also shows clothing items 402 to the right of the Ironing to be done divider 300, 301 that the consumer-user has indicated needs ironing before wearing.

Figure 4A:
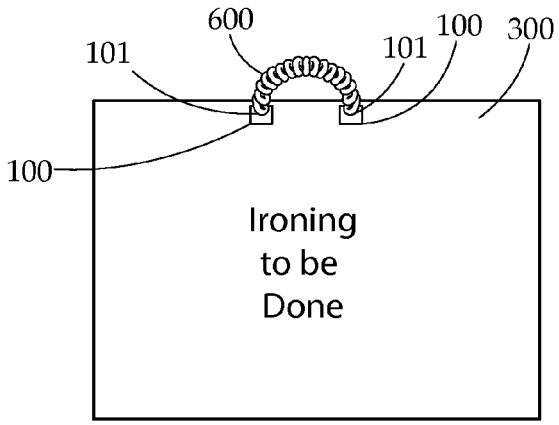
FIGS. 4A and 4B are prospective views of the front and reverse sides of the Ironing to be done plastic laminate divider that hangs over a closet clothing rod and organizationally divides a consumer's hanging clothing within said closet, based on what the consumer-user needs to iron.
Figure 4B:
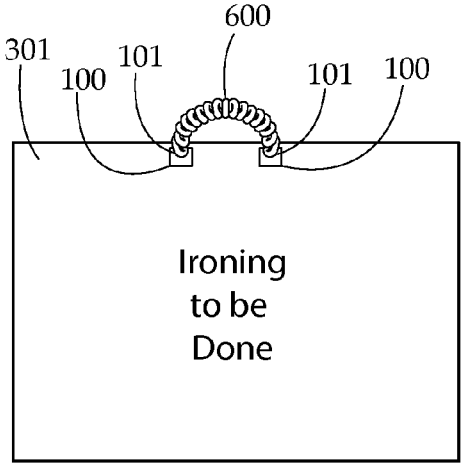

FIGS. 4A and 4B depict a prospective view of the identical front 300 and reverse 301 sides of the Ironing to be done plastic laminate divider that hangs over a closet clothing rod 601 to organizationally divide a consumer's hanging clothing within said closet that requires ironing before wearing. The adjustable divider hanging mechanism 600 is threaded through one hole 101, over the closet clothing rod 601, and back through the second hole 101, which is placed at a distance far enough away from the first hole 100 to accommodate the girth of a closet clothing rod 601.

Figure 5A:
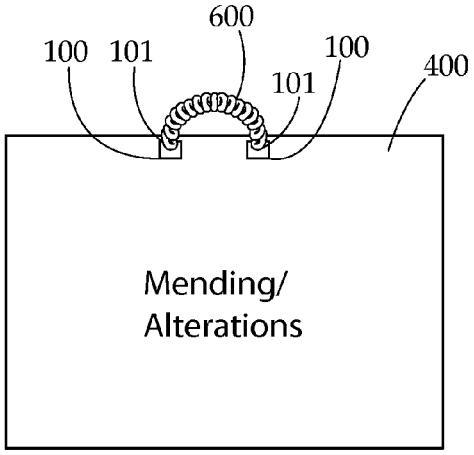
FIGS. 5A and 5B are prospective front and reverse views of the Mending/Alterations plastic laminate divider that hangs over a closet clothing rod and organizationally divides a consumer-user's hanging clothing within said closet, based on what the consumer-user needs to mend or alter.
Figure 5B:
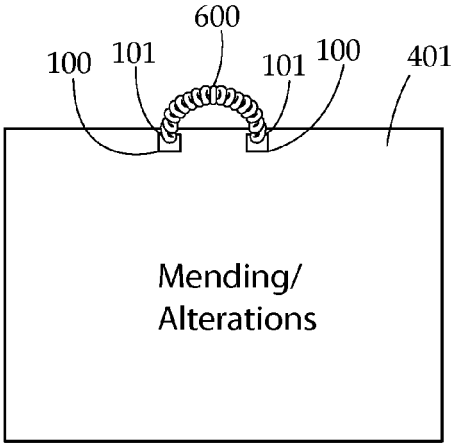

FIGS. 5A and 5B show a prospective view of the identical front 400 and reverse 401 sides of the Mending/Alterations plastic laminate divider that hangs over a closet clothing rod 601 and organizationally divides a consumer's hanging clothing within said closet, based on what the consumer needs to mend or alter. The adjustable divider hanging mechanism 600 is threaded through one hole 101, over the closet clothing rod 601, and back through the second hole 101, which is placed at a distance far enough away from the first hole 100 to accommodate the girth of a closet clothing rod 601.

Figure 5C:
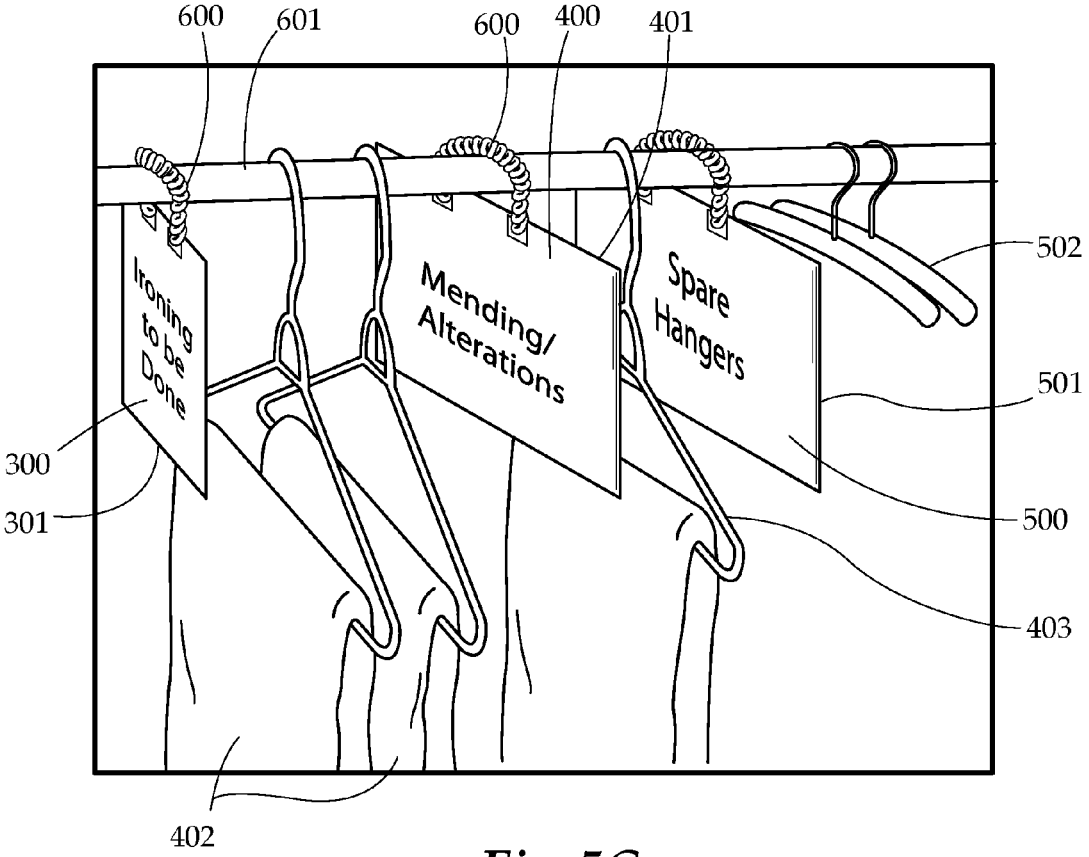
FIG. 5C is a perspective view of (i) clothing items that have been placed in between the Ironing to be done divider in FIGS. 4A and 4B and the Mending/Alterations divider in FIGS. 5A and 5B, indicating they need ironing before wearing, (ii) a clothing item that has been placed in between the Mending/Alterations divider in FIGS. 5A and 5B and the Spare Hangers divider in FIGS. 7A and 7B, indicating it requires mending or alterations before wearing, and (iii) spare, empty hangers placed behind the Spare Hangers divider in FIGS. 7A and 7B.

FIG. 5C shows a perspective view of (i) clothing items that have been placed in between the Ironing to be done divider 300, 301 and the Mending/Alterations 400, 401 divider, indicating the items need ironing 402 before wearing, (ii) a clothing item that has been placed in between the Mending/Alterations divider 400, 401 and the Spare Hangers divider 500, 501, indicating it requires mending or alterations before wearing 403, and (iii) spare, empty hangers 502 placed behind the Spare Hangers divider 500, 501.

Figure 6A:
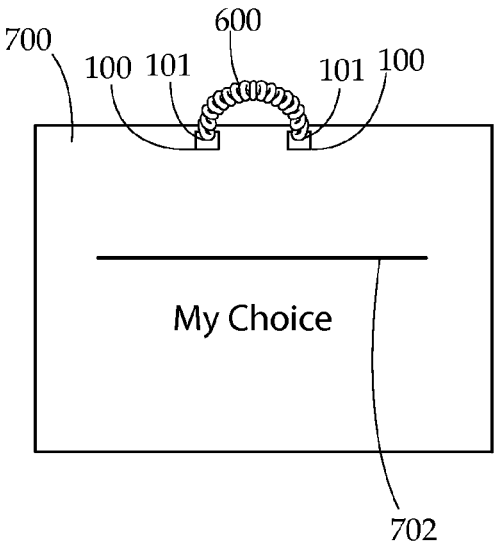
FIGS. 6A and 6B are prospective views of front and reverse sides of the My Choice customizable plastic laminate divider that hangs over a closet clothing rod and organizationally divides a consumer's closet based on any consumer-user-designated category.
Figure 6B:
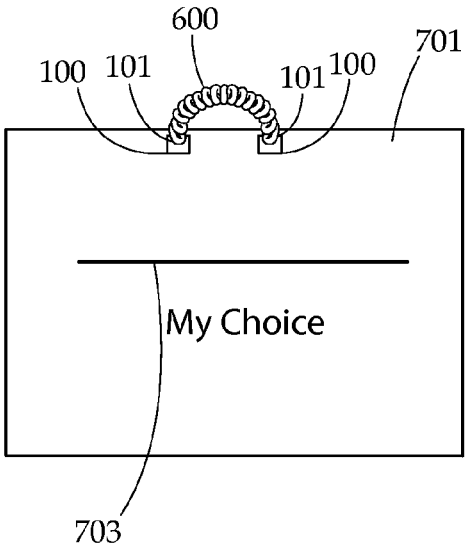

FIGS. 6A and 6B illustrate a prospective view of the front 700 and reverse 701 sides of the My Choice customizable laminate divider that hangs over a closet clothing rod 601 and organizationally divides a consumer's closet based on any consumer-designated category. The adjustable divider hanging mechanism 600 is threaded through one hole 101, over the closet clothing rod 601, and back through the second hole 101, which is placed at a distance far enough away from the first hole 100 to accommodate the girth of a closet clothing rod 601. The front 700 side and reverse 701 side each contain a shaded box 702, 703, respectively, on which the consumer-user may write or otherwise indicate a category of clothing to separate on the closet clothing rod 601. These designations are at the sole discretion of the consumer-user, but may include, without being limited to, seasonal categories, special event categories, a specific clothing-type designation, or otherwise.

Figure 6C:
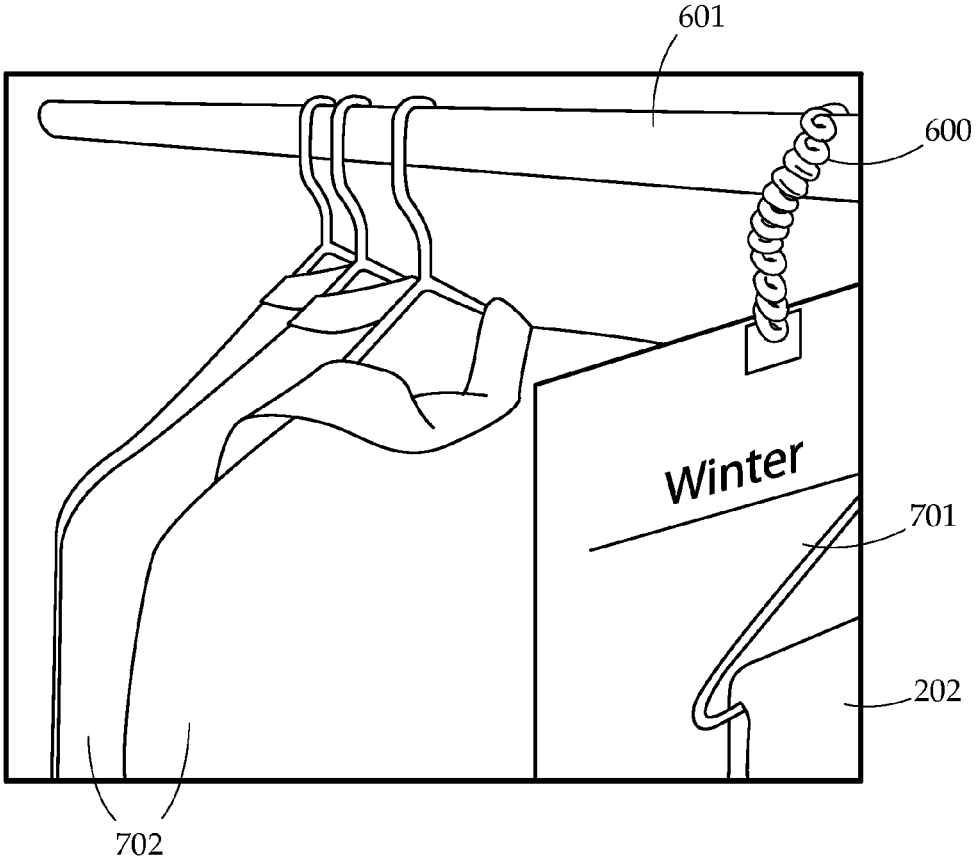
FIG. 6C is a perspective view of one possible use of the My Choice customizable divider in FIGS. 6A and 6B that a consumer-user has designated to separate winter clothing items from all other items.

FIG. 6C illustrates a perspective view of one possible use of the My Choice (customizable divider) 701 that a consumer-user has designated to separate winter clothing items 702 from Discerning items 202.

Figure 7A:
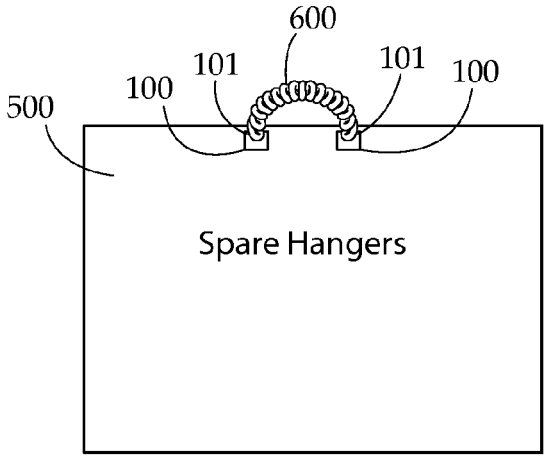
FIGS. 7A and 7B are prospective views of the front and reverse sides of the Spare Hangers plastic laminate divider that hangs over a closet clothing rod and organizationally divides a consumer-user's spare or empty hangers within said closet.
Figure 7B:
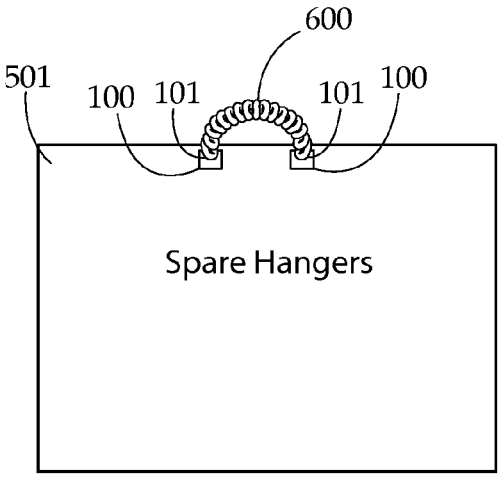

FIGS. 7A and 7B show a prospective view of the identical front 500 and reverse 501 sides of the Spare Hangers plastic laminate divider that hangs over a closet clothing rod 601 and organizationally divides a consumer-user's spare or empty hangers. The adjustable divider hanging mechanism 600 is threaded through one hole 101, over the closet clothing rod 601, and back through the second hole 101, which is placed at a distance far enough away from the first hole 100 to accommodate the girth of a closet clothing rod 601.

Figure 7C:
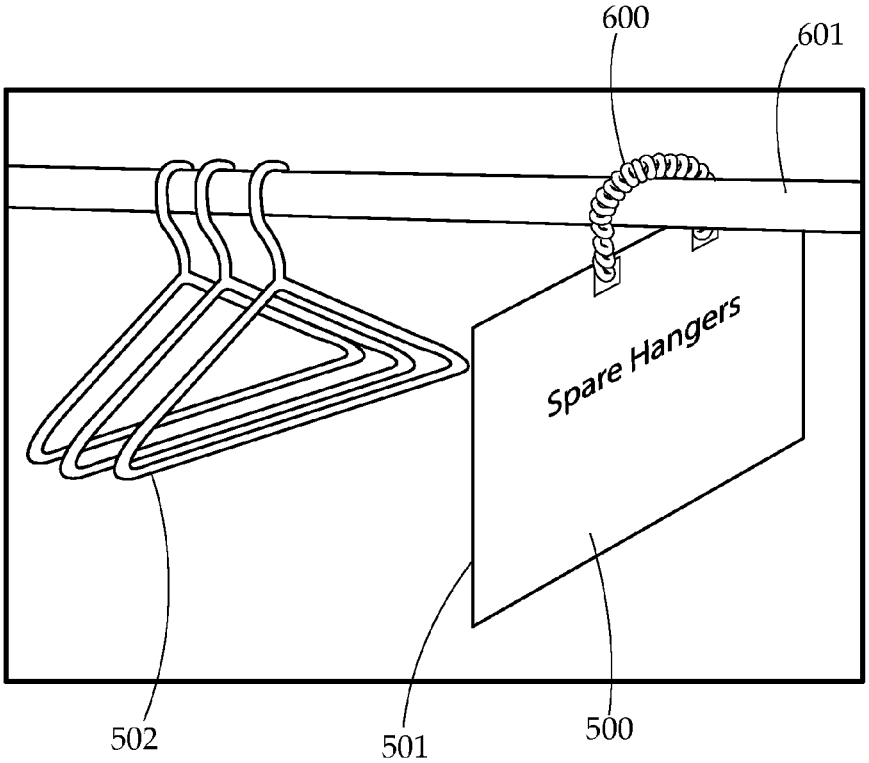
FIG. 7C is a perspective view of a beginning-stage organization effort by a consumer-user, where the user has set up the Spare Hangers divider in FIGS. 7A and 7B and placed spare, empty hangers behind it.

FIG. 7C depicts a perspective view of a beginning-stage left-to-right-oriented organization effort by a consumer-user, where the user has set up the Spare Hangers divider 500, 501 and hung spare, empty hangers behind it 502.

Figure 8:
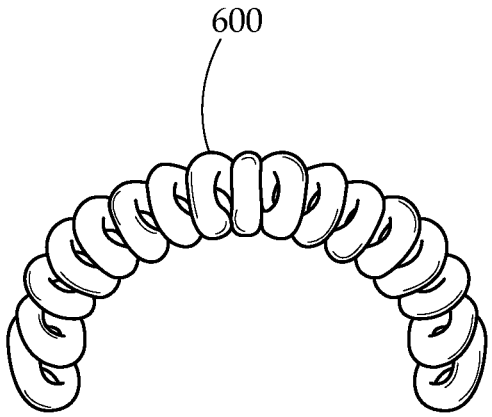
FIG. 8 is a perspective view of a coiled elastic cord used to hang the plastic laminate dividers over a closet clothing rod as described in FIGS. 2-7.

FIG. 8 shows a perspective view of an adjustable divider hanging mechanism 600 used to hang the plastic laminate dividers (200, 201, 203, 205, 300, 301, 400, 401, 500, 501, 700, 701) over a closet clothing rod 601 by threading into one hole 101 of any said dividers (200, 201, 203, 205, 300, 301, 400, 401, 500, 501, 700, 701), over a closet clothing rod 601, and through the second hole 101 of any the dividers (200, 201, 203, 205, 300, 301, 400, 401, 500, 501, 700, 701).

Figure 9:
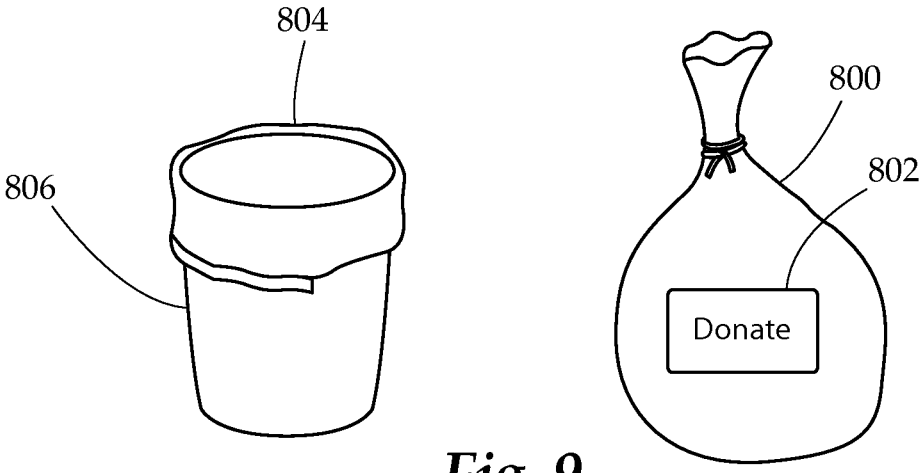
FIG. 9 is a perspective front view of the Donate plastic bag designated with a consumer-applied label used to donate clothing items that the consumer decides to give away.

FIG. 9 depicts a perspective front view of the Donate bag 800 designated with a preprinted, consumer-applied label 802 used to donate clothing items that the consumer decides to give away. The Donate bag may be made from any suitable material know by one in the art such as plastic, cloth, canvas, nylon, cotton, mesh, etc. The Donate bag 800 may be stored on the floor of the closet in which the consumer-user uses the present invention 90, without any supporting mechanism, with a supporting outer shell 806 to keep the Donate bag 800 open and/or upright 804, or in any other convenient configuration as the consumer-user sees fit.

Figure 10:
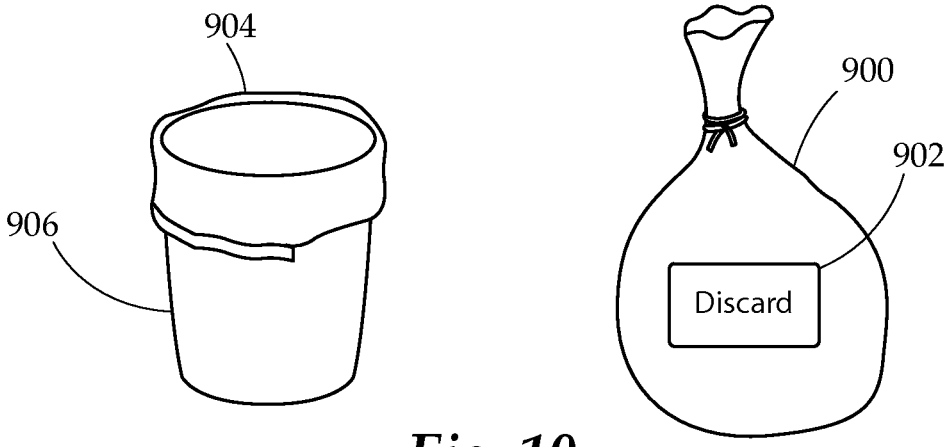
FIG. 10 is a perspective front view of the Discard plastic bag designated with a consumer-applied label used to discard clothing items that the consumer decides to throw out.

FIG. 10 depicts a perspective front view of the Discard bag 900 designated with a preprinted, consumer-applied label 902 used to discard clothing items that the consumer decides to give away. The Discard bag may be made from any suitable material known to one in the art such as plastic, cloth, canvas, nylon, cotton, mesh, etc. The Discard bag 900 may be stored on the floor of the closet in which the consumer-user uses the present invention 90, without any supporting mechanism, with a supporting outer shell 906 to keep the Donate bag 900 open and/or upright 904, or in any other convenient configuration as the consumer-user sees fit.

The recommended method of using the present invention 90 first involves a consumer-user moving all clothing to one end of the closet clothing rod 601. Next, the consumer-user will insert one end of the coiled adjustable divider hanging mechanism 600 through one hole 101 of each divider (200, 201, 300, 301, 400, 401, 500, 501, 700, 701), over the newly created empty space on closet clothing rod 601, and back through the second hole 101, which is located at a distance far enough away from the first hole 100 to accommodate the girth of a closet clothing rod 601.

The dividers should be placed in the following order, but can be ordered from either left to right or from right to left: My Choice customizable divider 700, 701, Discerning/Decided divider 200, 201, Ironing to be done divider 300, 301, Mending/Alterations divider 400, 401, and Spare Hangers divider 500, 501. FIG. 1 shows the left-to-right ordering of dividers.

Next, the consumer user may apply the Donate label 802 and Discard label 902 to their respective bags 800, 900.

The consumer-user may then take all empty hangers 502 and place to the right of the Spare Hangers divider 500,501 if clothes are pushed to the left side of the closet, as shown in FIG. 7C, or to the left of the Spare Hangers divider 500, 501

(if clothes are pushed to the right side of the closet), keeping only a couple of each kind of hanger at any time. Any clothes needing mending or alterations 403 should then be hung between the Mending/Alterations divider 400, 401 and the Spare Hangers divider 500, 501, as shown in FIG. 5C. Any clean clothes needing ironing 402 should then be hung between the Ironing to be done divider 300, 301 and the Mending/Alterations divider 400, 401, as also shown in FIG. 5C. Next, the consumer-user will begin sorting through all remaining clothes, keeping the following general principles in mind:

a. if clothes are too large, but still wearable, put into the Donate bag 800; or if the consumer-user believes he/she may wear them again at some point, they can be packed away into a box and stored in another place, outside of the everyday-used closet.
b. if clothes are too large but not wearable, put into the Discard bag 900;
c. if clothes are too small, either put in the Donate bag 800, or if the consumer-user believes he/she will wear again at some point, they can be packed away into a box and stored in another place, outside of the everyday-used closet.

Now, the consumer-user is able to address all remaining clothing 202. For clothing that has not been worn in a while, the consumer-user can take time to discern and decide, considering questions such as the last time the item was worn, whether it fits, whether it is stained, torn, or missing buttons, whether the item is still in good condition. In addition, the following questions are imprinted on the Discerning side of the divider to give the consumer-user visual cues with each item under consideration: Does it fit? Do I like it? Does it make me feel great? Does it fit the life I'm living now? The answers to these questions will drive the consumer to keep, mend, donate, or discard the item. Once a consumer-user has worn a piece of clothing and determines he/she will wear it again:

a. If it needs laundering and will require ironing afterwards, after laundering, hang it between the Ironing to be done designation divider 300, 301 and the Mending/Alterations divider 400, 401, as shown in FIG. 5C, until it is ironed. After ironing, it can be placed in between the Decided divider 201 and the Ironing to be done divider 300, 301, as shown in FIG. 3C.
b. If it does not need laundering, hang it between the Decided divider 201 and the Ironing to be done designation divider 300, 301, as shown in FIG. 3C.
c. If an item needs mending or alteration, hang it between the Mending/Alterations divider 400, 401 and the Spare Hangers 500, 501 divider, as shown in FIG. 5C.

Repeat the process with each piece of clothing you select. If clothing needs further discerning, place the clothing on the Discerning side of the divider 200 until a decision is made based on the time frame the consumer-user decides on.

Any new items of clothing will always start between Discerning side of the divider 200, until actually worn. If, after wearing any item, the consumer-user decides not to wear an item again, he/she will put it in the Donate bag 800 if it is wearable, or the Discard bag 900 if unwearable. Both bags 800, 900 may be kept inside the closet, on the floor, in a supporting container 806, 906, or wherever is convenient for the consumer-user.

Ultimately, the consumer-user can continuously address the clothing that is on the Discerning side of the divider 200, 201 at their own time and pace, with confidence and a peace of mind that they can let go of anything that will not be worn, and with satisfaction that he/she is helping someone else to enjoy an item, or that he/she has reaped the best value and most possible use out of an item. Once the consumer-user has no more items left on the Discerning side of the divider and everything is between the Decided an Ironing to be done dividers, the consumer-user can move the items back to the Discerning side of the divider to repeat the process and keep any clothing clutter at bay.

In conclusion, herein is presented a personal clothing management system and associated method of use. The invention is illustrated by example in the flow diagrams and figures, and throughout the written description. It should be understood that numerous variations are possible, while adhering to the inventive concept. Such variations are contemplated as being a part of the present invention.

What is claimed is:

1. A personal clothing-management-system kit comprising:

a plurality of two-sided hanging designation dividers;
a plurality of adjustable designation divider hangers;
a Donation bag; and
a Discard bag,
wherein the plurality of two-sided hanging designation dividers further comprises at least two holes located in a top zone of the plurality of two-sided hanging designation dividers, where the at least two holes are at least large enough in diameter to receive the plurality of adjustable designation divider hangers, separated by a distance at least large enough to accommodate a girth of a closet clothing rod.

2. The personal clothing-management-system kit of claim 1, wherein the Donation bag and the Discard bag further comprise: at least one adhesive label to indicate each bag's purpose as Donation bag and Discard bag.

3. The personal clothing-management-system kit of claim 1, where the plurality of two-sided hanging designation dividers further comprises:

at least one individual from the plurality of two-sided hanging designation dividers indicating clothing items for "Discerning" on one side and clothing items which will be kept on the other "Decided" side;
at least one individual from the plurality of two-sided hanging designation dividers identifying clothing items that "Ironing to be done";
at least one individual from the plurality of two-sided hanging designation dividers identifying clothing "Mending or Alternations";
at least one individual from the plurality of two-sided hanging designation dividers identifying "Spare Hangers"; and
at least one individual from the plurality of two-sided hanging designation dividers with a space for the consumer-user to identify any identification category.

4. The personal clothing-management-system kit of claim 1, wherein the plurality of two-sided hanging designation dividers are composed of a material selected from the group consisting of: semi-rigid to rigid plastic-laminated stock, plastic, paper, material-covered paper, compressed cardboard, man-made material, and any combination thereof.

5. The personal clothing-management-system kit of claim 1, wherein the plurality of adjustable designation divider hangers are composed of a material selected from the group consisting of: cloth and nylon elastic material that remains in a coiled configuration when no pulling force is exercised on the plurality of adjustable designation divider hangers.

6. The personal clothing-management-system kit of claim 1, wherein the at least two holes at least two holes receive the plurality of adjustable designation divider hangers.

7. The personal clothing management-system kit of claim 1, wherein the plurality of two-sided hanging designation dividers hang freely, constrained by only gravity, the plurality of adjustable designation divider hangers, and clothing items.

8. The personal clothing management-system kit of claim 1, wherein the Donation bag and the Discard bag are each independently capable of volumetrically holding at least thirteen gallons.

9. The personal clothing management-system kit of claim 1, wherein, the Donation bag and the Discard bag are each comprised of a material selected from the group consisting of: a durable plastic, cloth, nylon, fabric, paper, man-made, natural, and any combination thereof.

10. The personal clothing management-system kit of claim 1, wherein the plurality of two-sided hanging designation dividers further comprises a rectangular size no less than 8.5 inches long and 11 inches wide.

11. The personal clothing management-system kit of claim 1, wherein the plurality of two-sided hanging designation dividers is hung using the plurality of adjustable designation divider hangers, hangs in a landscape orientation, with a long side of the plurality of two-sided hanging designation divider extending parallel to a floor and ceiling, and the short side of the plurality of two-sided hanging designation divider extending perpendicularly to the floor and ceiling.

12. The personal clothing management-system kit of claim 1, wherein the plurality of two-sided hanging designation dividers is hung using the plurality of adjustable designation divider hangers, hangs in a landscape orientation, with the short side of the plurality of two-sided hanging designation divider extending parallel to the floor and ceiling, and the long side of the divider extending perpendicularly to the floor and ceiling.

13. The personal clothing management-system kit of claim 1 wherein, the shape of the plurality of two-sided hanging designation dividers is selected from the group consisting of: a rectangular, square, oval, circular, semi-circular, free-form, clothing-silhouette, trapezoid, rhombus, and any combination thereof.

14. A method of organizing a personal closet or wardrobe utilizing the personal clothing management-system kit of claim 1 comprising of steps for:

preparing a clothing closet rod;

assembling a plurality of two-sided hanging designation dividers comprising of:

inserting at least one end of a plurality of adjustable designation divider hangers through a first hole in at least one individual from the plurality of two-sided hanging designation dividers over the clothing closet rod, and through a second hole in the at least one individual from the plurality of two-sided hanging designation dividers;

installing the plurality of two-sided hanging designation dividers;

customizing at least one individual from the plurality of two-sided hanging designation dividers; and preparing a donate bag and a discard bag.

15. The method of using the personal clothing management-system kit of claim 14, wherein the preparing the clothing closet rod further comprises sliding any clothing items to one end of the closet clothing rod.

16. The method of using the personal clothing management-system kit of claim 14, wherein the preparing the donate bag and the discard bag further comprises:

affixing an adhesive label to each bag, indicating each bag's purpose.

17. The method of using the personal clothing management-system kit of claim 14, wherein installing the plurality of two-sided hanging designation dividers further comprises:

placing any spare, empty hangers behind the at least one individual from the plurality of two-sided hanging designation dividers identified as "Spare Hangers";

placing any clothing items requiring ironing in between the at least one individual from the plurality of two-sided hanging designation dividers identified as "Ironing to be done" and the at least one individual from the plurality of two-sided hanging designation dividers identified as "Mending/Alterations";

sorting through any remaining clothing items wherein:

placing wearable clothing items that the consumer-user no longer wants into the Donate bag;

placing unwearable clothing items that the consumer-user could not donate into the Discard bag;

placing any items that the consumer-user feels he/she might use again at some future time into a separate container and stored outside of the closet in another location;

placing any clothing items that the consumer-user has decided to keep and wear between the at least one individual from the side of the divider identified as "Decided" and the at least one individual from the side of designation dividers identified as "Ironing to be done";

placing any clothing items that need further discerning by the consumer-user between the at least one individual from the side of the divider identified as "Discerning" and the at least one individual from the side of the designation dividers identified as "Decided";

placing any new clothing items between the at least one individual from the side of the designation dividers identified as "Discerning" and the side of the designation dividers identified as "Decided" until worn at least once;

wearing a clothing item and placing newly-empty clothing hangers behind the at least one individual from the plurality of two-sided hanging designation dividers identified as "Spare Hanger";

deciding to keep just-worn clothing item wherein:

after washing or deciding clothing item does not need washing, ironing, mending, or altering: placing between the at least one individual from the side of the designation dividers identified as "Decided" and the at least one individual from the side of the designation dividers identified as "Ironing to be done";

after washing clothing item, if clothing item needs ironing: placing clothing item in between the at least one individual from the plurality of two-sided hanging designation dividers identified as "Ironing to be done" and the at least one individual from the plurality of two-sided hanging designation dividers identified as "Mending/Alterations";

after washing clothing item, if clothing item needs mending or alterations: placing clothing item between the at least one individual from the plurality of two-sided hanging designation dividers identified as "Mending/Alterations" and the at least one individual from the plurality of two-sided hanging designation dividers identified as "Spare Hangers";

deciding to not keep just-worn clothing item:

placing clothing item in either Donate bag or Dispose bag based on whether clothing item is wearable or unwearable;

repeating above steps as needed, to manage volume and size of consumer-user's clothing items in closet.

18. The method of using the personal clothing management-system kit of claim 14, wherein the customizing the at least one individual from the plurality of two-sided hanging designation dividers further comprises the consumer-user identifying a personal identifier for the at least one individual from the plurality of two-sided hanging designation dividers.

* * * * *